United States Patent [19]

Muldrow, Jr.

[11] 4,055,122

[45] Oct. 25, 1977

[54] METHOD OF PLACING BLASTING CHARGES IN WET BOREHOLES

[75] Inventor: Barney P. Muldrow, Jr., Ocala, Fla.

[73] Assignee: Gulf Oil Corporation, Pittsburgh, Pa.

[21] Appl. No.: 677,185

[22] Filed: Apr. 15, 1976

[51] Int. Cl.[2] ..... F42D 1/00

[52] U.S. Cl. ..... 102/23; 102/24 R; 299/13

[58] Field of Search ..... 149/2; 102/23, 24.2; 299/13

[56] References Cited

U.S. PATENT DOCUMENTS

| | | | |
|---|---|---|---|
| 2,383,542 | 8/1945 | Godfrey | 102/24 R |
| 3,195,928 | 7/1965 | Pasternack | 102/24 R |
| 3,276,371 | 10/1966 | Newman et al. | 102/24 R |
| 3,971,318 | 7/1976 | Burkle et al. | 102/24 R |

*Primary Examiner*—Edward A. Miller
*Attorney, Agent, or Firm*—Carl A. Cline

[57] ABSTRACT

In the quarrying of wet, poorly consolidated rock in which blasting charges are placed with the aid of a removable metal casing to prevent collapse of the walls of the boreholes, improved results are obtained by placing cardboard tubing inside the removable metal casing with internal bushings reinforcing the tubing joints instead of using external collars or connectors.

1 Claim, 1 Drawing Figure

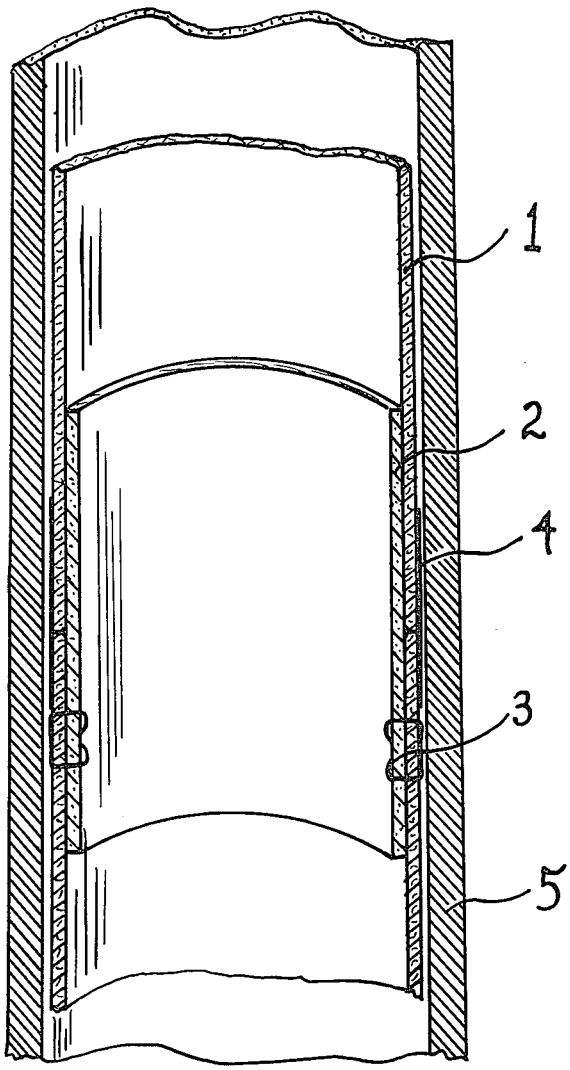
1
2
4
3
5

METHOD OF PLACING BLASTING CHARGES IN WET BOREHOLES

DESCRIPTION OF THE INVENTION

A. Background

Some deposits of types or rock such as limestone and dolomite are below the water table of the area in which they are found. Such deposits are porous, water-filled and poorly consolidated. When boreholes are made in these rock formations there is total collapse of the rock walls after the drill is withdrawn and the holes invariably quickly fill with sand and rock. A technique is now being used for drilling and setting blasting charges in which a so-called "kelly bar" drill is employed. In this method, a removable casing (outer drill bar) surrounding a rotary drill stem (inner bar) follows the drill bit down into the hole as it is drilled. The drill stem (inner bar) is then removed from the hole, packages of explosive are placed inside the metal casing (or kelly outer bar) and the metal casing is then pulled up out of the hole, leaving the explosive charges in place. Dynamite is the explosive customarily used in this method but because of the hazards involved in loading explosives inside the steel kelly bar a safer combination of explosive and loading technique is needed.

It might seem that this problem can be solved by using stiff, heavy-walled durable plastic tube casing for the explosive gel packages, but unfortunately this creates more problems than it solves. After the blasting, the plastic material is in the form of large pieces, mixed in with chunks of rock. This becomes a nuisance in the rock crushing and processing machines, particularly in the screening operations. What is needed for the temporary containment of the explosive is a tube which has the compressive strength to resist the collapse of the borehole walls after withdrawal of the kelly bar but which will disintegrate completely during the explosion. An ideal material for this purpose is cardboard tubing. Unfortunately the boreholes are deep enough so that a single tube of the required length is unmanageable. One solution to this problem which has been tried is the use of sections of convenient length, connected with external collar type couplings in a manner analogous to the way in which plastic plumbing pipes are connected.

The use of external collars or bushing connectors results in a loss of space inside the temporary casing, which might otherwise be occupied by explosive. It is therefore necessary to drill larger holes, at greatly increased expense. Furthermore, the external connectors frequently fail to prevent collapsing rock walls from opening the joints between sections of tubing.

B. Summary of the Invention

Briefly, my method of placing an aqueous gel explosive charge in a water-filled borehole in a poorly consolidated rock formation comprises the steps:

a. placing sections of cardboard tubing end-to-end inside a removable casing which is standing in a borehole containing water, while reinforcing and connecting the ends of the sections of cardboard tubing together by placing a close-fitting tubular bushing of sufficient compressive strength inside and extending for a substantial distance inside the ends of adjacent sections of tubing;

b. removing the removable casing (kelly bar) which surrounds the cardboard tubing, and c. filling the inside of the connected sections of cardboard tubing with an aqueous gel explosive composition.

C. Detailed Description

The method of this invention will be understood by reference to the drawing, in which there is illustrated in longitudinal cross-section the cardboard tubing, 1, connected by the internal sleeve, 2, held in place in the end of one tubing section by staples, 3, the two sections being secured by adhesive tape, 4, and the whole assembly standing inside the removable casing or kelly bar, 5. The method is further illustrated by means of the following specific examples.

EXAMPLE 1

Boreholes were made with a kelly bar drill in which the temporary casing (kelly bar) had an inside diameter of 5 inches (12.7 cm). Into the kelly bar were lowered four twelve-foot sections of cardboard tubing having a wall thickness of 5/32 in. (4mm.) and internal diameter of 4 9/16 in. (11.6 cm.). The ends of the sections of cardboard tubing were connected with internal sleeves of ⅛ in. (3 mm.) wall thickness hard cardboard tubing of 4 9/16 in. (11.6 cm) outside diameter, about 8 in. (20 cm) in length. The procedure for assembly was as follows: The sleeve was placed in one end of a tubing section, secured in place by driving metal (aluminum) staples through the outside of the tubing section, the end of a second tubing section was placed over the protruding portion of the sleeve, so that the two ends were in contact, then was also fixed in place by means of adhesive tape wrapped around the outside of the joint. The temporary casing (kelly bar) was then withdrawn, leaving the cardboard tubing standing in the water-filled borehole. The joints withstood the collapse of the walls of the borehole without failure and were pumped full of aqueous gel explosive in preparation for blasting.

EXAMPLE 2

In a manner similar to Example 1, cardboard tubing having an inside diameter of 2 ⅛ in. (5.4 cm) was placed inside a temporary casing (kelly bar) of 2 ½ in. (6.3 cm) inside diameter, the ends of cardboard tubing section being joined by hard cardboard sleeves of ⅛ in. (3 mm) wall thickness, approximately 8 in. long, stapled and taped into place. The temporary casing (kelly bar) was withdrawn and the cardboard tube was filled with aqueous gel explosive, without failure.

It was calculated that in Example 1 there was put into place in each foot of borehole ½ pound (227 g) more explosive than had been possible with tubing connected with external collars. In Example 2 there was obtained an increase of 0.22 lb (100 g) of explosive in place in each foot of borehole.

While cardboard has been exemplified as the material of choice for containment of the explosive in the borehole, it should be understood that other easily shattered materials, such as ceramic tile or concrete tile may be used without creating subsequent problems in processing the quarried rock. However, at the present time no other suitable tubing has thin enough walls to permit the loading of such large amounts of explosive per foot of borehole as can be achieved with cardboard tubing. This advantage outweighs other considerations.

I claim:

1. The method of placing an aqueous gel explosive charge in a water-filled borehole in a poorly consolidated rock formation comprising the steps:

a. placing sections of cardboard tubing end-to-end inside a removable casing which is standing in a borehole containing water, while reinforcing and connecting the ends of the sections of cardboard tubing together by placing a close-fitting tubular bushing of sufficient compressive strength inside and extending for a substantial distance inside the ends of adjacent sections of tubing;

b. removing the removable casing which surrounds the cardboard tubing, and c. filling the inside of the connected sections of cardboard tubing with an aqueous gel explosive composition.

* * * * *